United States Patent [19]

Fisher et al.

[11] Patent Number: 4,534,161

[45] Date of Patent: Aug. 13, 1985

[54] RING SPINNING PROCESSES FOR CONVERTING SLIVER TO CARPET YARN

[75] Inventors: Don E. Fisher, Pensacola; Arnold E. Wilkie, Pensacola Beach, both of Fla.

[73] Assignee: Monsanto Company, St. Louis, Mo.

[21] Appl. No.: 645,988

[22] Filed: Aug. 31, 1984

Related U.S. Application Data

[63] Continuation of Ser. No. 460,213, Jan. 24, 1983, abandoned.

[51] Int. Cl.[3] ..... D01H 7/60

[52] U.S. Cl. ..... 57/125

[58] Field of Search ..... 57/125, 119

[56] References Cited

U.S. PATENT DOCUMENTS

| | | | |
|---|---|---|---|
| 2,121,647 | 6/1938 | Wentworth | 57/125 |
| 2,831,313 | 4/1958 | Burns et al. | 57/125 X |
| 2,926,485 | 3/1960 | Morin | 57/125 |
| 3,396,527 | 8/1968 | Joseph et al. | 57/125 |
| 3,411,286 | 11/1968 | Wayson | 57/125 X |
| 3,444,900 | 6/1969 | Eldridge et al. | 57/59 |

*Primary Examiner*—Donald Watkins

*Attorney, Agent, or Firm*—John W. Whisler

[57] ABSTRACT

An improvement in the conventional process for converting sliver to carpet yarn on a ring spinning frame is described. The improvement increases the productivity of the frame and at the same time provides bulkier yarn. The improvement is achieved by utilizing a specially designed traveler which permits the frame to be operated at higher throughputs.

6 Claims, 5 Drawing Figures

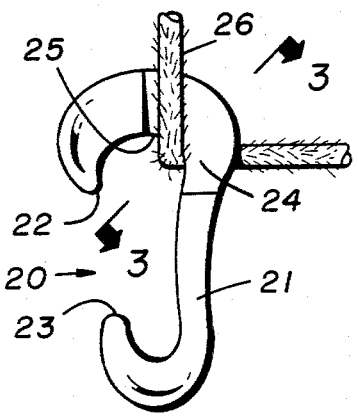
FIG. 2.
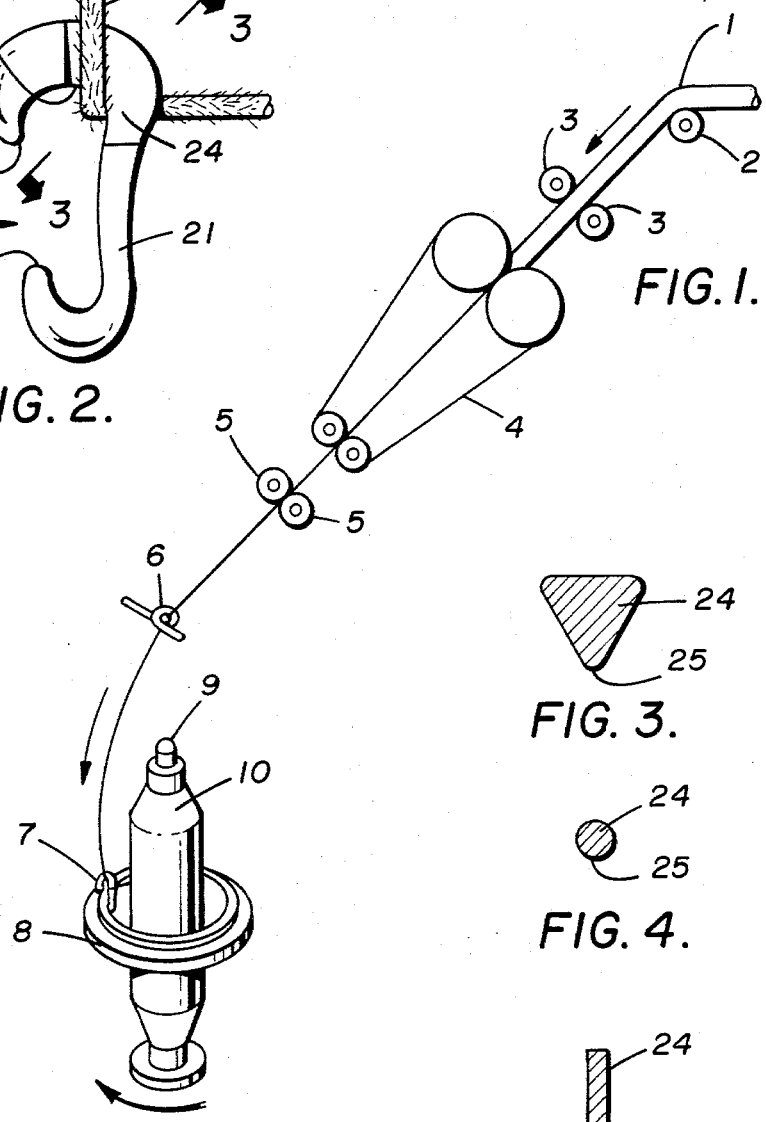
FIG. 1.
FIG. 3.
FIG. 4.
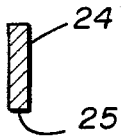
FIG. 5.

RING SPINNING PROCESSES FOR CONVERTING SLIVER TO CARPET YARN

This is a continuation of application Ser. No. 460,213, filed Jan. 24, 1983, now abandoned.

BACKGROUND OF THE INVENTION

A. Field of the Invention

This invention relates to travelers useful in ring spinning of staple into yarn. More particularly, the invention relates to specially designed travelers which permit ring spinning frames to be operated under conditions that provide low twist yarn of increased bulk at higher yarn throughputs (productivity) than is otherwise possible using conventional travelers.

B. Description of the Prior Art

Carpet staple in the form of sliver (a loosely assembled strand of staple fibers without twist) is coverted to useful yarn on ring spinning frames. The frames consist of a plurality of positions or stations each of which processes sliver. Each position comprises drafting rolls, a ring-and-traveler take-up mechanism, and a bobbin mounted on a rotatable spindle. The drafting of the sliver and the twisting and winding of the yarn onto the bobbin proceed sequentially and continuously. Travelers used in spinning carpet yarns are usually ear-shaped and range in weight from 3.0 grains (0.2 grams) for a 6's cotton count to 18.0 grains (1.2 grams) for a $1\frac{1}{2}$ cotton count. Conventionally, travelers used in spinning the coarser counts are not only heavier, but also taller and wider in cross-section. In commercial practice, ring spinning frames are operated under conditions which maximize the productivity of the frames. Such conditions include operating the spindle at its highest practical mechanical speed and then adjusting the peripheral speed of the delivery rolls so that just enough twist is inserted in the sliver to keep the winding tension from pulling the sliver apart before it can be would onto the bobbin. For example, under such conditions the spinning of a $2\frac{1}{2}$ cotton count staple yarn requires about 4.25 turns of twist per inch (167.3 turns per m) which corresponds to a processing speed of about 40 ypm (36.8 mpm). While a reduction in twist level in the yarn would improve the bulk of the yarn, such a reduction cannot be achieved on a conventional ring spinning frame without sacrificing productivity to a trade-off the industry is not willing to make.

SUMMARY OF THE INVENTION

It is an object of the present invention to provide a means which permits a conventional ring spinning frame to be operated under conditions such that a yarn of reduced twist level and increased bulk is produced at higher productivity than is otherwise possible.

The object of the invention is accomplished by providing a traveler for use on conventional carpet ring spinning frames characterized in that the radius of curvature (Ry) of the inside edge of the traveler which is in contact with the yarn during spinning (yarn contact edge) is less than 20 mils (0.5 mm). The traveler of the invention permits the front rolls (delivery rolls) of spinning frames to be operated at higher peripheral speeds than is possible if conventional carpet ring spinning frame travelers are used. Travelers useful in practicing the invention generally have a weight in excess of 3.0 grains (e.g. 3.0 to 18.0 grains) and usually in excess of 5.0 grains.

BRIEF DESCRIPTION OF THE DRAWING

FIG. 1 is a schematic representation of a conventional ring spinning frame.

FIG. 2 is a side elevation of a traveler of the present invention.

FIG. 3 is an enlarged cross-section taken along line III—III in FIG. 2 and shows the cross-section of the yarn contact edge of the traveler.

FIGS. 4 and 5 each show an alternative cross-section to that shown in FIG. 3.

DESCRIPTION OF THE PREFERRED EMBODIMENTS

The travelers of this invention are capable of increasing the productivity of conventional carpet ring spinning frames and providing spun yarn of a reduced twist level and increased bulk. A typical ring-spinning frame useful for producing carpet yarn is shown in FIG. 1. Referring to FIG. 1, the frame comprises a pair of driven nip rolls 3 which serve as feed rolls, an apron drafting system 4, having two pair of nip rolls (referred to as middle rolls), a pair of driven nip rolls 5 (referred to as front rolls or delivery rolls), a guide 6, traveler 7, ring 8, and spindle 9, and bobbin 10 mounted on spindle 9. Each pair of nip rolls is driven at a peripheral speed correlated to give the desired drafting (e.g. 20 times) and throughput. In operation of the frame, strand 1 in the form of a sliver is passed over guide roll 2 through the drafting zone and is delivered by delivery rolls 5 to traveler 7 via guide 6. The hook-like ends of traveler 7 engage the outside face of ring 8 and retain traveler 7 during processing despite the up and down motion of ring 8 relative to bobbin 10 and the traveling of traveler 7 around ring 8 at high speeds. Strand 1, now in the form of a twisted yarn, makes a partial wrap around the inside edge of traveler 7 enroute to the bobbin 10. The wrap is made by the passage of the yarn through the opening defined by ring 7 and traveler 8. Traveler 7 rotates concentrically around spindle 9 at a speed less than the rotational speed of the spindle 9 in order to allow the yarn to be wound onto bobbin 10. The rotational path of traveler 7 around spindle 9 inserts twist in sliver 1 (one turn of twist per rotation of traveler 7) which backs up from traveler 7 to the nip of delivery rolls 5. Sufficient twist must be inserted in sliver 1 to keep it from pulling apart during the spinning process. (When a strand is pulled apart during operation of the frame for whatever reason, such occurrences are referred to as "ends down".) Using a conventional traveler and operating spindle 10 at its maximum practical speed, there is a maximum speed (delivery speed) at which yarn can be delivered to traveler 7 without causing "ends down".

By replacing a conventional carpet ring spinning frame traveler with the specially designed traveler of the present invention, the delivery speed of the sliver can be significantly increased, for example, by a factor of two or more. This has a two-fold effect. It increases the productivity of the frame by a corresponding factor and also reduces the twist level of the resulting yarn by approximately the same factor. Reducing the twist level increaes the bulk of the yarn.

The travelers of the present invention are characterized in that the yarn contact edge thereof has a radius of curvature (Rc) less than 20 mils (0.50 mm), for example 10 to 20 mils (0.25 to 0.50 mm). In general, reducing Rc permits the speed of the delivery rolls to be increased without causing ends down. However, the radius of curvature of the yarn contact edge of the traveler should not be so small as to provide a razor-like edge which would tend to cut the yarn.

A preferred traveler of the present invention is shown in FIG. 2. Referring to FIG. 2, the ear-shaped traveler 20 has a main body section 21 terminating in hook ends 22 and 23 and a wedge-shaped yarn contact section 24 having a yarn contact edge 25. The cross-section of section 24 is shown in FIG. 3. When the traveler is in use, edge 25 is in contact with staple yarn 26 as shown in FIG. 3. Instead of having the wedge-shaped yarn contact section 24 shown in FIG. 3, the traveler alternatively may be fabricated to have a circular-shaped (FIG. 4) or a rectangular-shaped (FIG. 5) yarn contact section or any other shape, providing that the yarn contact edge 25 thereof has a radius of curvature of less than 20 mils.

The travelers may be constructed from conventional materials such as plastic or metal. Preferably, the travelers of the present invention differ from conventional travelers only in the shape of the yarn contact section of the traveler and, therefore, may be of a conventional shape, e.g., ear-shaped.

EXAMPLE 1

This example demonstrates the advantages gained by using a traveler designed in accordance with the present invention. In the example, spinning runs are carried out using one position of a conventional Whitin NW ring spinning frame, in which 70-grain per yard (4.9 grams per meter) sliver composed of nylon 66 staple fibers having a length of 7½ inches (19.05 cm), a denier of 15 and an average of 9 crimps per inch (354 cpm) is converted to spun yarn having twist in the Z direction. The ring of the spinning frame has an inside diameter of 4½ inches (11.4 cm).

In certain of the spinning runs, a conventional ear-shaped plastic traveler is used. In other spinning runs the same traveler is used but it is modified to have a wedge-shaped yarn contact section resembling that of the traveler shown in FIG. 3. In each of the runs the spindle is operated at 5500 rpm and the front roll speed is adjusted to provide the lowest possible twist level in the final product without causing the yarn to break before it can be wound onto the bobbin.

In runs where a conventionally-shaped traveler is used the lowest twist level that is achieved in the product (spun yarn) is about 4 turns per inch (157.5 turns per m). In contrast, in runs where a traveler of the present invention is used a twist level as low as 3 turns per inch (118.1 turns per m) in the product is obtained. In one run the yarn contact section of the traveler shaped in accordance with the invention is circular in cross-section (diameter=20 mils or 0.5 mm) having a radius of curvature of 10 mils (0.25 mm). The low twist yarns prepared using the travelers of the present invention are bulkier than the corresponding higher twist yarns prepared using conventional travelers. Moreover, when preparing the low twist yarns, the front rolls are operated at higher speeds, thereby increasing the productivity of the frame.

What is claimed is:

1. In a process for continuously converting sliver to carpet yarn on a spinning frame wherein the sliver is drafted and twisted to form a yarn that is delivered by means of delivery rolls to a traveler around which the yarn makes a partial wrap before being wound onto a bobbin mounted on a spindle rotating at its maximum practical mechanical speed, the improvement comprising in combination (1) using a traveler having a weight ranging from 3.0 to 18.0 grains (0.2 to 1.2 grams) and a yarn contact section characterized in that the yarn contact edge thereof has a radius of curvature of less than 20 mils (0.5 mm), and (2) operating said delivery rolls at a delivery speed which is higher than possible when using a traveler having a yarn contact edge with a radius of curvature greater than 20 mils (0.5 mm).

2. The process of claim 1 wherein the traveler is ear-shaped.

3. The process of claim 2 wherein the yarn contact section of the traveler is circular in cross-section.

4. The process of claim 3 wherein the weight of the traveler is in excess of 5 grains (0.3 grams).

5. The process of claim 4 wherein the sliver is composed of nylon 66 staple fibers.

6. The process of claim 5 wherein the yarn is a 2½ cotton count yarn.

* * * * *